United States Patent [19]

Batten

[11] Patent Number: 4,854,198

[45] Date of Patent: Aug. 8, 1989

[54] HAND WRENCHING TOOL

[76] Inventor: Ronald W. Batten, 5618 White Ct., Torrance, Calif. 90503

[21] Appl. No.: 84,580

[22] Filed: Aug. 11, 1987

Related U.S. Application Data

[63] Continuation-in-part of Ser. No. 887,054, Jul. 18, 1986, abandoned.

[51] Int. Cl.[4] ..... B25B 13/28

[52] U.S. Cl. ..... 81/98; 81/94

[58] Field of Search ..... 81/92, 94, 97, 98, 99, 81/111

[56] References Cited

U.S. PATENT DOCUMENTS

| | | | |
|---|---|---|---|
| 282,768 | 8/1883 | Pollard | 81/98 |
| 651,574 | 6/1900 | Meredith | 81/98 |
| 701,462 | 6/1902 | Bettmann | 81/98 |
| 715,900 | 12/1902 | Thompson | 81/98 |
| 1,380,822 | 6/1921 | Mason | 81/98 |
| 1,754,717 | 4/1930 | Hughens | 81/98 |
| 3,241,409 | 3/1966 | Raptis | 81/94 |

FOREIGN PATENT DOCUMENTS

| | | | |
|---|---|---|---|
| 0073958 | 3/1894 | Fed. Rep. of Germany | 81/98 |
| 1958614 | 5/1971 | Fed. Rep. of Germany | 81/98 |
| 2022610 | 11/1971 | Fed. Rep. of Germany | 81/98 |
| 0026212 | of 1913 | United Kingdom | 81/98 |
| 827767 | 2/1960 | United Kingdom | 81/98 |

*Primary Examiner*—Frederick R. Schmidt
*Assistant Examiner*—Blynn Shideler
*Attorney, Agent, or Firm*—Plante, Strauss & Vanderburgh

[57] ABSTRACT

The invention is a wrenching tool useful for loosening the locking collars of frangible fasteners which are commonly used in the aerospace industry. The tool has a socket head with an end of reduced thickness to provide a land on which is pivotally received the jaw end of a handle. The through socket of the head is traversed by the vertical shoulder between the head and its reduced thickness end, thereby providing an open area to the socket. The jaw end of the handle projects into this open area to grasp items within the socket, such as the narrow wall of the locking collar of a frangible fastener. In this application, the jaw end of the handle can be placed flush against the surface of the workpiece, thereby firmly grasping even very narrow locking collars. The wrenching tool can also be used to apply a frangible fastener by inverting the tool and grasping the hex collar in its socket. If necessary, the wrenching tool is used with a hex key wrench to immobilize the fastener bolt during removal or application of the frangible fastener.

11 Claims, 2 Drawing Sheets

HAND WRENCHING TOOL

This application is a continuation-in-part of parent application, Ser. No. 887,054 now abandoned, filed July 18, 1986.

BACKGROUND OF THE INVENTION

1. Field of the Invention

This invention relates to a wrenching tool, and in particular to a hand tool useful for removal of frangible fasteners.

2. Brief Statement of the Prior Art

Frangible fasteners are used extensively in the aerospace industry. These fasteners employ a threaded nut member which has a threaded collar and a distal wrenching ring joined by a neck with a notched section which shears from the collar when the applied torque exceeds a predetermined torsional loading. Often the threaded collar has an upset portion, usually a slightly elliptical shape to provide a frictional spring lock that prevents the fastener from spinning off in the event that the residual tension on the fastener is lost.

These fasteners are applied with power driven, or hand, wrenching tools which engage the distal wrenching ring to apply the threaded collar and twist the wrenching ring from the threaded collar when the predetermined torsional loading is exceeded.

It is frequently desirable to loosen or remove the threaded collar from the assembled fastener. Heretofore, no entirely suitable tool has been devised for this application. The threaded collar commonly has a cylindrical base which tapers into a smaller diameter cylindrical neck. The cylindrical portions of these collars are narrow and are difficult to grasp with conventional tools such a pliers and vise grip clamps, etc. Additionally, the use of non-standard tools for loosening or removing of the frangible fasteners is objectionable as such tools can damage the surfaces of the assembled parts.

A universal wrench has been marketed which uses a socket head with a pivotally attached handle. In this tool, the handle has a jaw end that is received in a slot in the side of the head, and the gripping surface of the tool is thus centrally located within the head. This tool is not suitable for removing the fasteners used in the aerospace industry as narrow collars of the fasteners cannot be readily grasped by this tool.

BRIEF DESCRIPTION OF THE INVENTION

This invention comprises a wrenching tool which is designed specifically for the loosening and removal of collars of frangible fasteners from assembled fasteners. For this purpose the wrenching tool has a head having a first end of a major thickness and an opposite end of reduced thickness to provide a planar land, with a single vertical shoulder between the two ends. The reduced thickness end has a distal aperture and pivotally receives the jaw end of an elongated handle. The handle has a beveled, toothed edge which provides its jaw end. The handle also has an aperture extending through the jaw end and a pin is used to pivotally mount the handle to the head. The head has a socket which is traversed by the vertical shoulder to provide a central open area, open to the socket. The socket is a single through aperture which has at least two lobes on its inside wall that are symmetrically located opposite the reduced thickness end. The jaw end of the handle extends through the central open area of the vertical shoulder, into the socket of the head when the components are assembled such that rotation of the head on its pivotal engagement with the handle advances the toothed portion of the handle into the socket area.

BRIEF DESCRIPTION OF THE DRAWINGS

The invention described with reference to the figures of which.

DESCRIPTION OF PREFERRED EMBODIMENT

Figure 1:
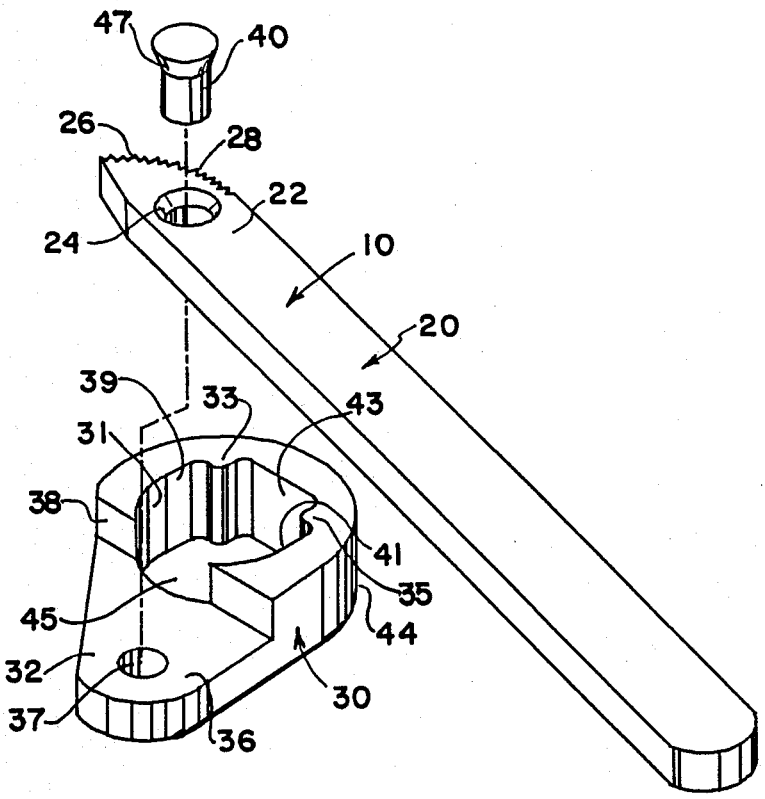
FIG. 1 is an exploded perspective view of the wrenching tool.

Referring now to FIG. 1, the wrenching tool 10 of the invention comprises an assembly of a handle 20 and a socket head 30 which is secured by a pin 40. FIG. 1 illustrates the components in exploded view. As there illustrated, the head has a reduced thickness portion at end 32 formed with a planar surface land 36, and a full thickness portion at end 44 with a single shoulder or step 38 between the two portions. The head 30 has a through socket 31 (shown in FIG. 4) which is traversed by the shoulder 38 to provide a central, area 49, which is open to the socket. Additionally, the inside wall of the socket 31 has two, symmetrically located, internal lobes 33 and 35 which are positioned opposite the shoulder 38. The opposite side walls 39 and 41 of the socket, which extend between the lobes and the central open area 49 are arcuate. The end wall 43 which extends between the lobes 33 and 35 is planar. The reduced thickness end 32 has a single through aperture 45 which tightly receives the pin 40 in a press fit, thereby pivotally securing the assembly of handle and head, and terminates flush with the outside surface of head 30.

The handle is an elongated bar having a jaw end 22 which has a single through aperture 24 and an arcuatelled edge 26 which is formed with serrated teeth 28. The teeth 28 are spaced at angular spacings of 6 degrees on an arc with a radius which is from 2 to 4, preferably 3 times the distance between the center of aperture 37 and the central open area 45. The preferred teeth are formed with a 90 degree tooth angle. Pin 40 is loosely received in aperture 24. Preferably, the pin has a tapered end 47 and is received in a countersunk recess in the jaw end 22 of handle 20, with its end flush with the surface of handle 20.

Figure 2:
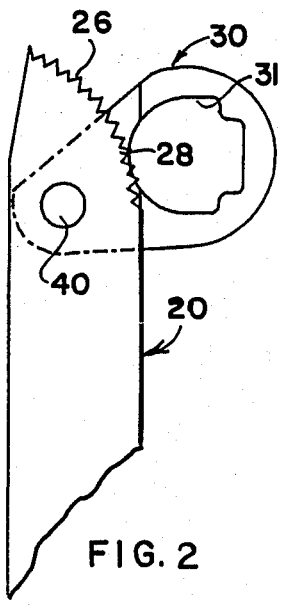
FIGS. 2–4 illustrate the wrenching tool with various positions of the head, illustrating adaptability of the head to fasteners of varied diameters.
Figure 3:
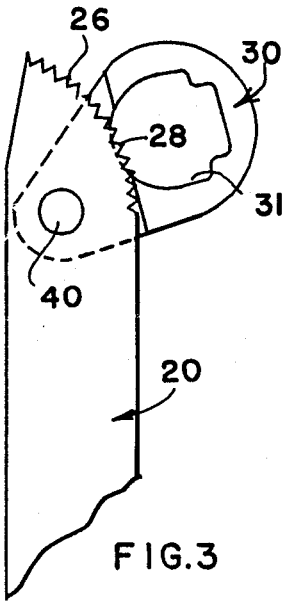
Figure 4:
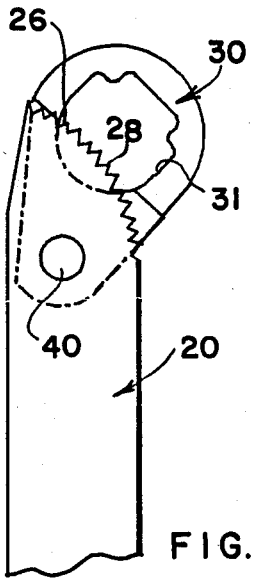

FIGS. 2–4 illustrate the assembled wrenching tool with various positions of the head in the assembly. FIG. 2 illustrates the head in its full open position rotated at an angle of approximately 60° or greater relative to the longitudinal axis of handle 20. The head 30 in this position has its socket 31 unencumbered by the teeth 28 which are located on the accurately bevelled edge 26 of the handle. In FIG. 3, the head 30 is rotated to an angle of approximately 45° with the longitudinal axis of handle 20. Since the radius of the arcuate bevel of end 22 is greater than the distance between aperture 24 and the open central area 45, the rotation of the head will advance the teeth 28 of the arcuate edge 26 into the socket 31 of head 30 and into a position to be in locking relationship to a fastener body received in the socket (not shown).

FIG. 4 illustrates the wrenching tool 10 in its position to lock the smallest diameter fastener with which it can be used. In this illustration, the head 30 is rotated to a position approximately coaxially with the longitudinal axis of the handle 10 and the serrated teeth 28 on the arcuately bevelled edge 26 of the handle project substantially into the socket 31 of the head 30, thus being in a position to grasp relatively small diameter fasteners received in the socket.

Figure 5:
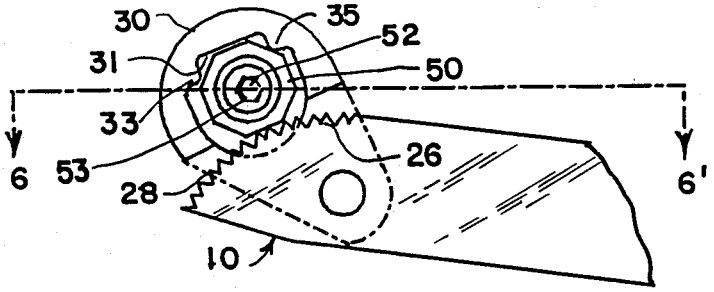
FIG. 5 is a plan view of the wrenching tool as applied to the wrenching hex for installation of a frangible fastener.
Figure 6:
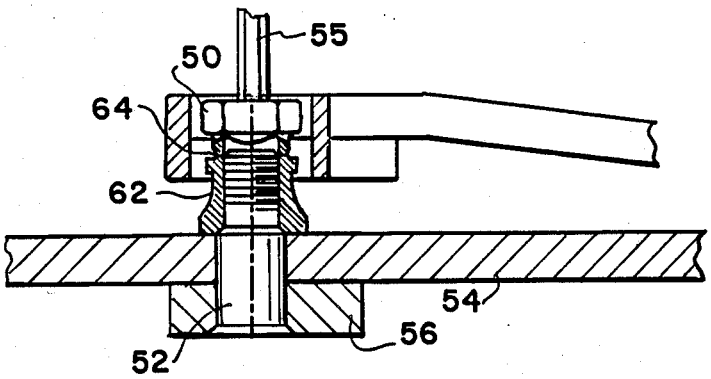
FIG. 6 is a view along lines 6—6' of FIG. 5.

As previously mentioned, the wrenching tool is specifically designed for the removal and/or application of frangible fasteners. The attachment of a frangible fastener is illustrated by FIGS. 5 and 6. As there illustrated, the hexagonal wrenching ring 50 of a wrenching fastener that is engaged to a cooperative bolt 52 is received within socket 31 of head 30 and in this position is securely engaged by the serrated teeth 28 on the arcuately bevelled edge 26 of handle 20 of the tool 10. In this position, the rotation of the handle 10 in a clockwise direction as viewed in the illustration, will apply a fastening torque to the collar 50.

Referring now to FIG. 6, the wrenching collar 50 is illustrated in its assembly to the fastener bolt 52, both being operative to securely engage work plates 54 and 56 in joined assembly. As illustrated, the wrenching collar 50 is engaged in the socket with the symmetrically located lobes 33 and 35 (see FIG. 5) securely engaged against the hexagonal flats of the hex collar 50 and locked thereto by the force applied through handle 10 and the serrated teeth 28 of jaw 20. The frangible fastener is a conventional design in which the wrenching hex collar 50 is secured to the fastener ring 60 through a axial section 62 having a reduced cross section and groove 64 to provide a strain relieved neck which will shear from the fastening ring 60 when the application torque reaches a predetermined value. As illustrated, the wrenching tool 10 can, if desired, be used for this application. In the illustration, the tool 10 is used to apply a fastener in an interference fit. In many applications, a supplemental tool such as a hex key, or Allen wrench, is also used, and is inserted into a hex recess (shown at 53 in FIG. 5) in the end of the bolt 52 to immobilize the bolt 52 during application of the hex collar 50. This hex key 55 is shown in phantom lines in FIG. 6.

The preferred handle 20 has a slight bend (7 degrees) intermediate its length. The bend in the handle is preferred as it will prevent the use of the wrenching tool to be used in an application in which it can apply fastening torque to a cylindrical fastener 64. As previously mentioned, the cylindrical fastener 20 is applied by a limited torque, which is that torque sufficient to cause failure of the strain relieved neck (groove 64) and release of the wrenching collar 50. Thereafter, any fastening torque must be applied to the cylindrical collar 60. The socket 31 of the head of the tool cannot be applied to the cylindrical collar, as the bend in the handle requires that the socket be elevated above the work piece, as illustrated in FIG. 6. In this position, the socket cannot grasp the cylindrical collar 64.

Figure 7:
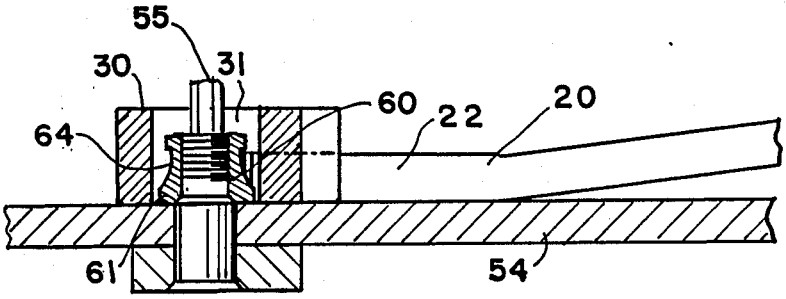
FIG. 7 is a view along lines 7—7' of FIG. 8.
Figure 8:
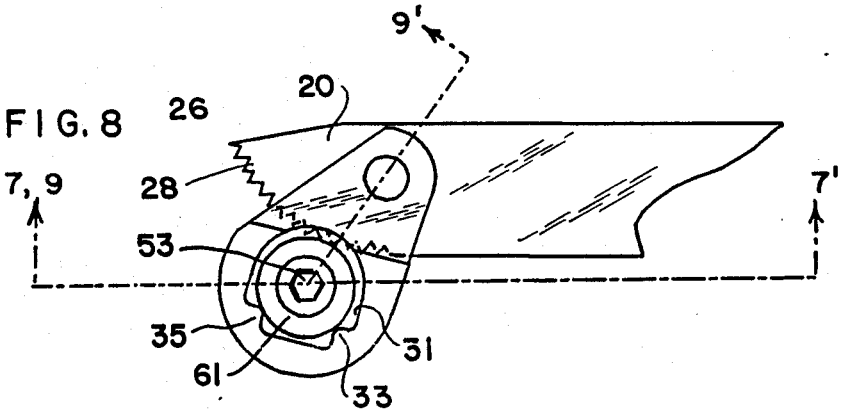
FIG. 8 is a plan view of the wrenching tool as applied to the removal of a fastener.
Figure 9:
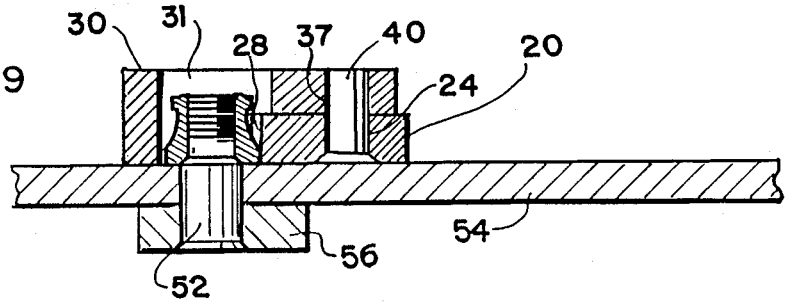
FIG. 9 is a sectional view along lines 9—9' of FIG. 8.

The wrenching tool of the invention however, is specifically designed for the loosening of frangible fasteners. For this purpose, the wrenching tool is reversed, side-to-side from its orientation shown in FIG. 6. When so reversed, the wrenching tool is designed to receive within its socket 31, the narrow cylindrical base of the fastening collar 60, all as shown in FIGS. 7–9. In the illustrations, the cylindrical fastening collar 60 is securely engaged by the opposed lobes 33 and 35 on the inside wall of collar 31 and is locked thereto by the serrated teeth 28 on the arcuate bevelled edge 26 of handle 20. A hex key, shown as 55 in phantom lines can be inserted into the hex recess 53 in the end of bolt 52, as needed to immobilize the bolt. As illustrated, the counterclockwise rotation of the handle 20 will forcefully rotate the fastening collar 60, securing its removal.

Referring now to FIG. 7, the narrow fastening collar 60 can be seen to be locked securely in the socket 31 of head 30 and, for this purpose, the jaw end 22 of the handle 20 is flush with the surface of the outer workpiece 54. In this application, the jaw of handle 20 firmly engages the narrow cylindrical wall 61 of the cylindrical fastener 60. As previously mentioned, the preferred handle 20 has a slight bend (7 degrees) intermediate its length and towards the head 30 so that it can be applied flush to a work surface 54 and still provide clearance for gripping of the handle by the user.

FIG. 9 shows a sectional view of the wrenching tool along lines 9—9′ of FIG. 8, which extends through the assembly pin 40 of the tool. As previously mentioned, pin 40 is loosely received in aperture 24 of the handle 20 and is retained in the assembly by a press fit in aperture 37 of head 30.

The wrenching tool of the invention is of very simple design, yet admirably serves the purpose of loosening and removing the fasteners that are commonly experienced in the aerospace industry. The handle with its locking jaw is coplanar with one surface of the head, thereby permitting the handle and locking jaw to be located flush with the surface of a part from which the fasteners are to be removed. This ensures that the locking collar with its cylindrical wall of limited thickness can be securely engaged by the wrenching tool, permitting the application of a sufficient torque to loosen the fastener.

Additionally the wrenching tool can, if desired, be reversed to be in a position for the application of a frangible fastener. For this purpose, when the tool is reversed side to side to the position to the position shown in FIGS. 5 and 6, the tool is operable to grip the wrenching collar of a fastener and apply that fastener to a bolt with sufficient torque that, when the fastening system is secure, will shear the wrenching collar from the locking collar. As previously mentioned, however, in this position, the bend in the handle of the preferred tool prevent its use to apply fastening torque to an installed locking collar.

The invention has been described with reference to the illustrated and preferred embodiment. It is not intended that the invention be unduly limited by this disclosure of preferred embodiments. Instead, it is intended that the invention be defined by the means, and their obvious equivalents, set forth in the following claims.

What is claimed is:

1. A wrenching tool for removing and securing frangible fasteners onto a work surface, and having:

(a) a socket head having a top surface and planar bottom surface, a first end of a first thickness and an opposite end of reduced thickness providing a single planar surface land with a single- vertical shoulder between said planar surface land and said top surface, a single through socket traversed by said vertical shoulder to provide an open central area of said shoulder which is open to said socket, and a single through aperture through said reduced thickness end;

(b) an elongated handle having a thickness which is substantially equal to the reduction of thickness of said head and having a jaw end with an arcuate end having a radius center, a plurality of teeth on said end, and a distal aperture at a center offset from said radius center, and with one side of said jaw end received on said land with said distal aperture aligned with said single through aperture of said head and the opposite side of said jaw end flush with said top surface of said head, a bend intermediate the length of said handle to permit placement of the jaw end of said handle flush against a work surface while providing hand gripping clearance and preventing reversal of said tool to place said top surface of said socket head flush against said work surface;

(c) an assembly pin received in said single through aperture of said socket head and said distal aperture of said handle to pivotally attach said handle to said head, with said apertures located on their respective head and handle to permit said toothed end edge of said handle to rotate into said open central area of said shoulder when said handle is pivoted on said head.

2. The tool of claim 1 wherein the radius of said arcuate end of said handle is greater than the distance between said single through aperture and said open central area of said shoulder, whereby said toothed end edge can be advanced into or retracted from said socket by pivotal movement on said head.

3. The tool of claim 1 wherein the radius of said arcuate end of said handle is from 2 to 4 times the distance from said single through aperture and said open central area.

4. The tool of claim 1 wherein said the inside wall of said socket has at least two axial lobes which are symmetrically located opposite said open central area.

5. The tool of claim 4 wherein the opposite side walls of said socket between each of said lobes and said open central area are arcuate.

6. The tool of claim 5 wherein the end wall of said socket, between said lobes and opposite said open central area is planar.

7. The tool of claim 4 wherein said pin is secured in a press fit in said distal aperture of said handle, flush with the outside surface of said handle.

8. The tool of claim 1 wherein the head of said pin is countersunk in a mating recess of said head and its end surface is flush with the surface of said head.

9. The tool of claim 1 wherein said handle is received on said head with its outer surface flush with the top surface of said first end of said head.

10. The tool of claim 9 wherein said handle has a 7-degree bend intermediate its ends.

11. The tool of claim 10 wherein bend directs the end of said handle from said outer surface.

* * * * *

US004854198B1

REEXAMINATION CERTIFICATE (3703rd)

United States Patent [19] [11] B1 4,854,198

Batten [45] Certificate Issued Jan. 12, 1999

[54] HAND WRENCHING TOOL

[75] Inventor: Ronald W. Batten, Torrance, Calif.

[73] Assignee: Fairchild Holding Corp., Chantilly, Va.

Reexamination Request:
No. 90/004,492, Dec. 19, 1996

Reexamination Certificate for:

| | |
|---|---|
| Patent No.: | **4,854,198** |
| Issued: | **Aug. 8, 1989** |
| Appl. No.: | **84,580** |
| Filed: | **Aug. 11, 1987** |

Related U.S. Application Data

[63] Continuation-in-part of Ser. No. 887,054, Jul. 18, 1986, abandoned.

[51] Int. Cl.[6] ..... B25B 13/28

[52] U.S. Cl. ..... 81/98; 81/94

[58] Field of Search ..... 81/92, 94, 97–99, 81/111

[56] References Cited

U.S. PATENT DOCUMENTS

| | | | |
|---|---|---|---|
| 1,075,100 | 10/1913 | Habel | 81/177.8 |
| 1,859,526 | 5/1932 | Pascoe | 81/98 |
| 2,733,736 | 2/1956 | McLaughlin | 81/98 X |

OTHER PUBLICATIONS

Hi–Shear Tool Catalog Dwg. No. HLH128, Sheets 1 and 2, copywrite, 1972.

*Primary Examiner*—Debra S. Meislin

[57] ABSTRACT

The invention is a wrenching tool useful for loosening the locking collars of frangible fasteners which are commonly used in the aerospace industry. The tool has a socket head with an end of reduced thickness to provide a land on which is pivotally received the jaw end of a handle. The through socket of the head is traversed by the vertical shoulder between the head and its reduced thickness end, thereby providing an open area to the socket. The jaw end of the handle projects into this open area to grasp items within the socket, such as the narrow wall of the locking collar of a frangible fastener. In this application, the jaw end of the handle can be placed flush against the surface of the workpiece, thereby firmly grasping even very narrow locking collars. The wrenching tool can also be used to apply a frangible fastener by inverting the tool and grasping the hex collar in its socket. If necessary, the wrenching tool is used with a hex key wrench to immobilize the fastener bolt during removal or application of the frangible fastener.

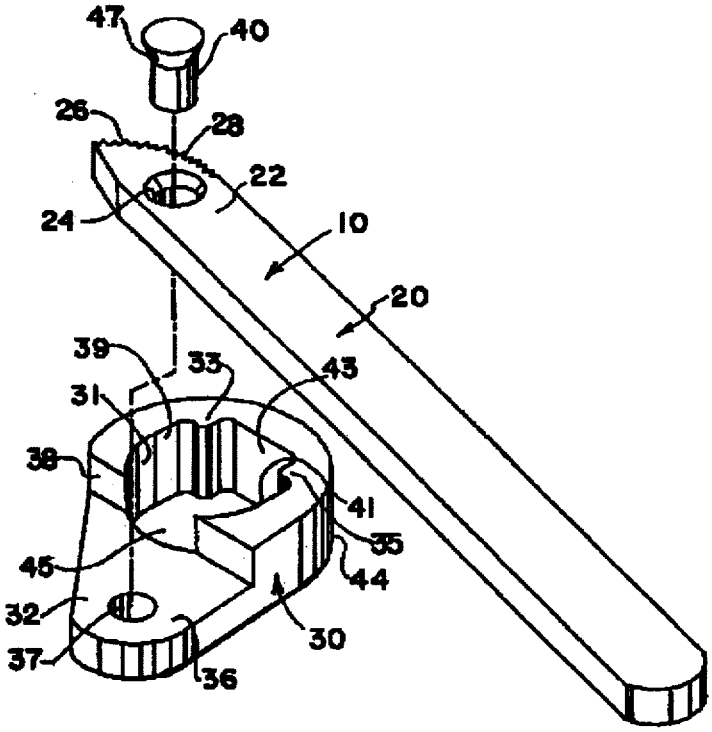

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *